US008128360B2

(12) United States Patent
Sensel et al.

(10) Patent No.: US 8,128,360 B2
(45) Date of Patent: Mar. 6, 2012

(54) VORTEX PUMP WITH SPLITTER BLADE IMPELLER

(75) Inventors: Daniel L. Sensel, Troy, OH (US); Mark Kowalak, Troy, OH (US)

(73) Assignee: Crane Pumps & Systems, Inc., Piqua, OH (US)

( * ) Notice: Subject to any disclaimer, the term of this patent is extended or adjusted under 35 U.S.C. 154(b) by 674 days.

(21) Appl. No.: 12/269,416

(22) Filed: Nov. 12, 2008

(65) Prior Publication Data

US 2009/0155048 A1 Jun. 18, 2009

Related U.S. Application Data

(60) Provisional application No. 60/987,189, filed on Nov. 12, 2007.

(51) Int. Cl.
*F04D 29/42* (2006.01)

(52) U.S. Cl. ..... 415/225; 415/203

(58) Field of Classification Search ..... 415/225, 415/203

See application file for complete search history.

(56) References Cited

U.S. PATENT DOCUMENTS

| | | | | |
|---|---|---|---|---|
| 3,759,628 | A * | 9/1973 | Kempf | 415/225 |
| 4,592,700 | A * | 6/1986 | Toguchi et al. | 415/225 |
| 4,676,718 | A | 6/1987 | Sarvanne | |
| 5,277,232 | A * | 1/1994 | Borsheim | 141/65 |
| 5,486,092 | A | 1/1996 | Borg et al. | |
| 7,357,341 | B2 | 4/2008 | Gutwein et al. | |
| 7,563,074 | B2 * | 7/2009 | Xu | 416/185 |

* cited by examiner

*Primary Examiner* — Jarrett Stark
*Assistant Examiner* — Nicholas Tobergte
(74) *Attorney, Agent, or Firm* — Standley Law Group LLP

(57) ABSTRACT

A vortex pump impeller utilizes primary blades in combination with splitter blades. An increase in total head is observed through exemplary impellers in a vortex pump, compared to an impeller lacking the splitter blades. Single stage and dual stage pumps utilizing the exemplary impellers are also disclosed. Exemplary pumps may also contain a grinder assembly.

15 Claims, 6 Drawing Sheets

VORTEX PUMP WITH SPLITTER BLADE IMPELLER

CROSS-REFERENCE TO RELATED APPLICATIONS

This application is a non-provisional patent application and claims priority to U.S. provisional application 60/987,189 filed on Nov. 12, 2007, which is incorporated by reference as if fully recited herein.

TECHNICAL FIELD

The disclosed embodiments relate generally to improvements in the impeller of a centrifugal pump, particularly in the impeller used in a vortex-type centrifugal pump. Some aspects relate to an improved vortex pump that incorporates the improved impeller in a one- or two-stage pump.

BACKGROUND OF THE ART

As described in U.S. Pat. No. 4,592,700 to Toguchi, vortex pumps are employed for pumping liquids that contain a substantial amount of foreign matter such as solids and/or fibriform matter. Because the foreign matter is a clogging hazard, the art has developed to provide a vortex chamber through which the pumped material generally passes, with an adjoining recessed chamber in which the impeller is rotatingly mounted. In some of these applications, at least the upper portion of the blades of the impeller extends into the vortex chamber, but the clear preference in avoiding contact between the foreign matter and the impeller is to have the entire impeller contained within the impeller chamber. The inventive concept disclosed in Toguchi '700, for example, involves an impeller in which the height of the blades is varied, so that some blades extend axially into the vortex chamber, while other blades do not.

As is also known from other prior art, including U.S. Pat. No. 4,676,718 to Sarvanne and U.S. Pat. No. 5,486,092 to Borg, the trade-off presented by avoiding contact of foreign matter with the impeller is a loss of efficiency and head when compared to a more conventional centrifugal pump.

It is therefore an unmet advantage of the prior art to provide unexpectedly improved efficiency and head from that of a vortex pump impeller as previously known.

SUMMARY OF THE INVENTION

This and other unmet advantages are provided by the device and method described and shown in more detail below.

BRIEF DESCRIPTION OF THE DRAWINGS

A better understanding of the disclosed embodiments will be obtained from a reading of the following detailed description and the accompanying drawings wherein identical reference characters refer to identical parts and in which.

DETAILED DESCRIPTION OF A PREFERRED EMBODIMENT

Figure 1:
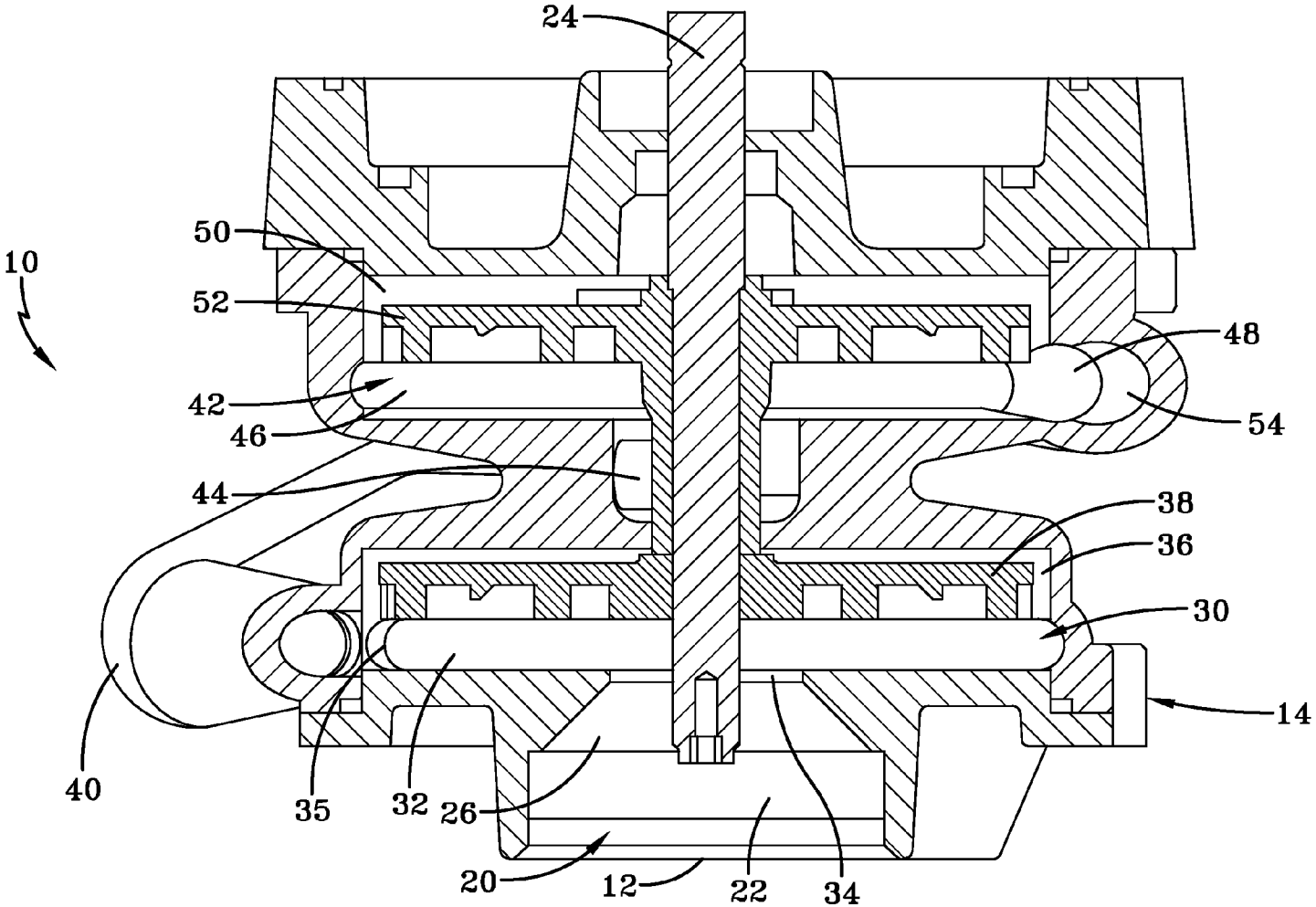
FIG. 1 is a side sectional view of a two-impeller grinder pump in which the improved impeller can be used.

FIG. 1 shows a vortex-type centrifugal pump 10 which is very similar to the two-stage sewage grinder pump shown and described in commonly-owned U.S. Pat. No. 7,357,341, of 15 Apr. 2008, which is incorporated as if fully recited herein. The improved features presented herein are believed to be useful in the grinder pump described in that patent, but the usefulness should extend to other known pump applications.

Liquid, typically containing foreign matter, enters pump 10 through opening 12, shown in this embodiment as being on a lower surface of a pump housing 14. Since the pump 10 will typically be installed in a sump basin (not shown) that receives the liquid, the lower surface opening 12 is particularly useful for drawing down the level in the basin. The motor (not shown) of the pump 10 is actuated when a level sensing device (not shown) determines that a threshold level of liquid has accumulated. The motor is commonly a 2 HP electrical motor. As the liquid and any entrained solids enter the opening 12, the solids are reduced in size in a grinder portion, shown generally as 20, where a rotating cutter 22 is mounted on the end of a shaft 24 driven by the motor. The cutter 22 is positioned within a stationary shredding ring 26. Since the structures of the grinder portion 20 will tend to throttle the flow rate to the first stage 30 of the pump 10, there will be some situations where the grinder will be eliminated or the spacing of cutting elements (not shown) will be adjusted to optimize flow.

The liquid that passes the cutter 22 flows axially upward into the first stage 30 where the pressure of the liquid is raised in the first of two stages. The first stage 30 has a vortex chamber 32 with an axial entrance 34 and a discharge 35. The vortex chamber may be shaped as a volute. An impeller recess 36 is positioned axially opposite the entrance 34 and a first impeller 38 is rotatingly mounted in the impeller recess. The first impeller 38 depicted in FIG. 1 is a vortex impeller as known in the prior art and does not depict characteristic features of the improved impeller that will be described in more detail below. However, notable features shown are the placement of the impeller recess 36 axially above the first stage vortex chamber 32, and the blade height of the impeller 38, which is sized to not impede flow in the vortex chamber.

Beyond the first stage discharge 36, the once-pressurized liquid flows through an interstage conduit 40 into the second stage 42. Interstage conduit 40 is connected to an axial entrance 44 that is communicated to the second stage vortex chamber 46, with a discharge 48. As in the first stage, the second stage vortex chamber 46 may be shaped as a volute. The second stage impeller recess 50 is positioned axially opposite the entrance 44 and a second impeller 52 is rotatingly mounted in the impeller recess. As with first impeller 38, the second impeller 52 depicted is typical of the prior art and does not portray characteristic features of the improved impeller that will be described in more detail below. When twice-pressurized liquid exits the second stage vortex chamber 46, it does so through discharge 48, which is communicated to a discharge conduit 54.

Even in this known pump configuration, some features that may be useful in the improved impellers, but which are not critical to their functioning, may be discerned. For example, both impellers 38, 52 will be very similar and will have a plurality of pumping blades on the face of the impeller base or shroud that faces into the vortex chamber. If needed, one or both of the impellers 38, 52 can include pump out vanes provided on an opposing rear face of the base or shroud. If the vortex chambers (and the impellers) are not of substantially identical diameter, the first stage vortex chamber and impeller will be larger than the corresponding second stage structure. It would be typical to design a two stage pump 10 of this type to divide the pressure increase evenly between the stages.

The mechanical seal between the second stage impeller recess and motor housing into which the shaft extends is conventional and will be known to one of skill in this art, as will be the techniques for forming the overall pump 10 by mating the pump housing 14 to a motor housing that contains the motor and protects it from moisture.

Figure 2:
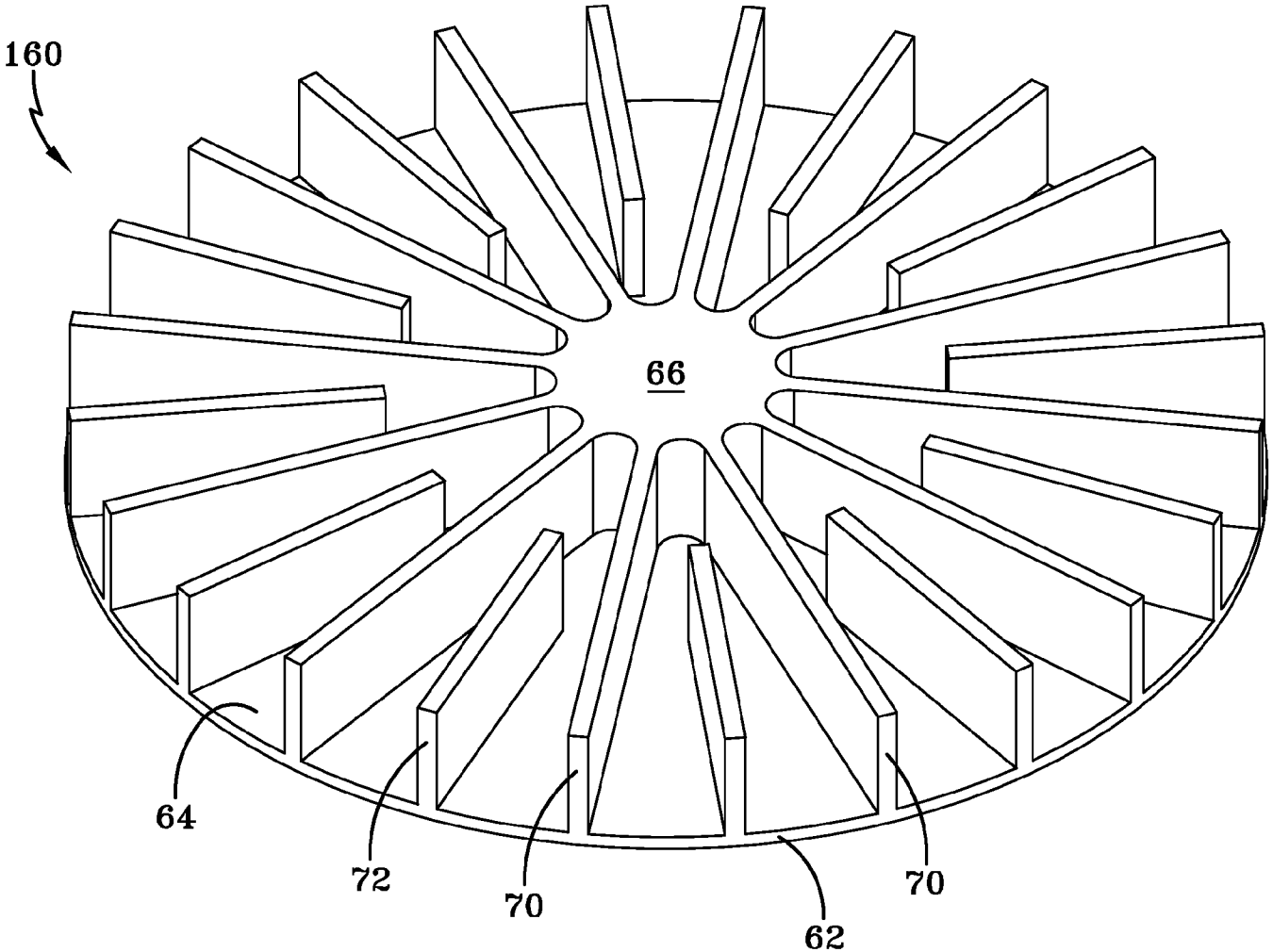
FIG. 2 is a perspective view of a first embodiment of the improved impeller.
Figure 3:
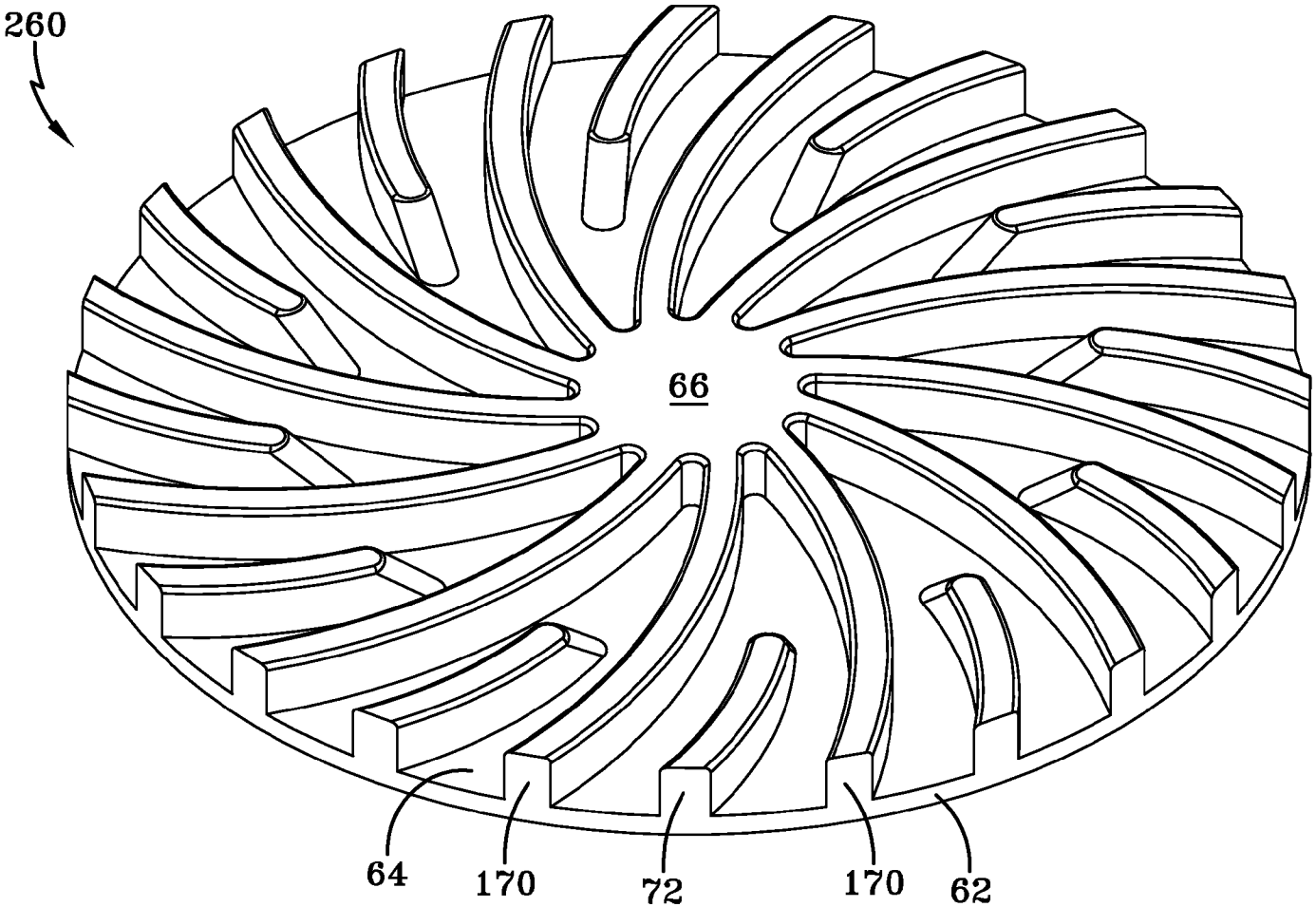
FIG. 3 is a perspective view of a second embodiment of the improved impeller.
Figure 4:
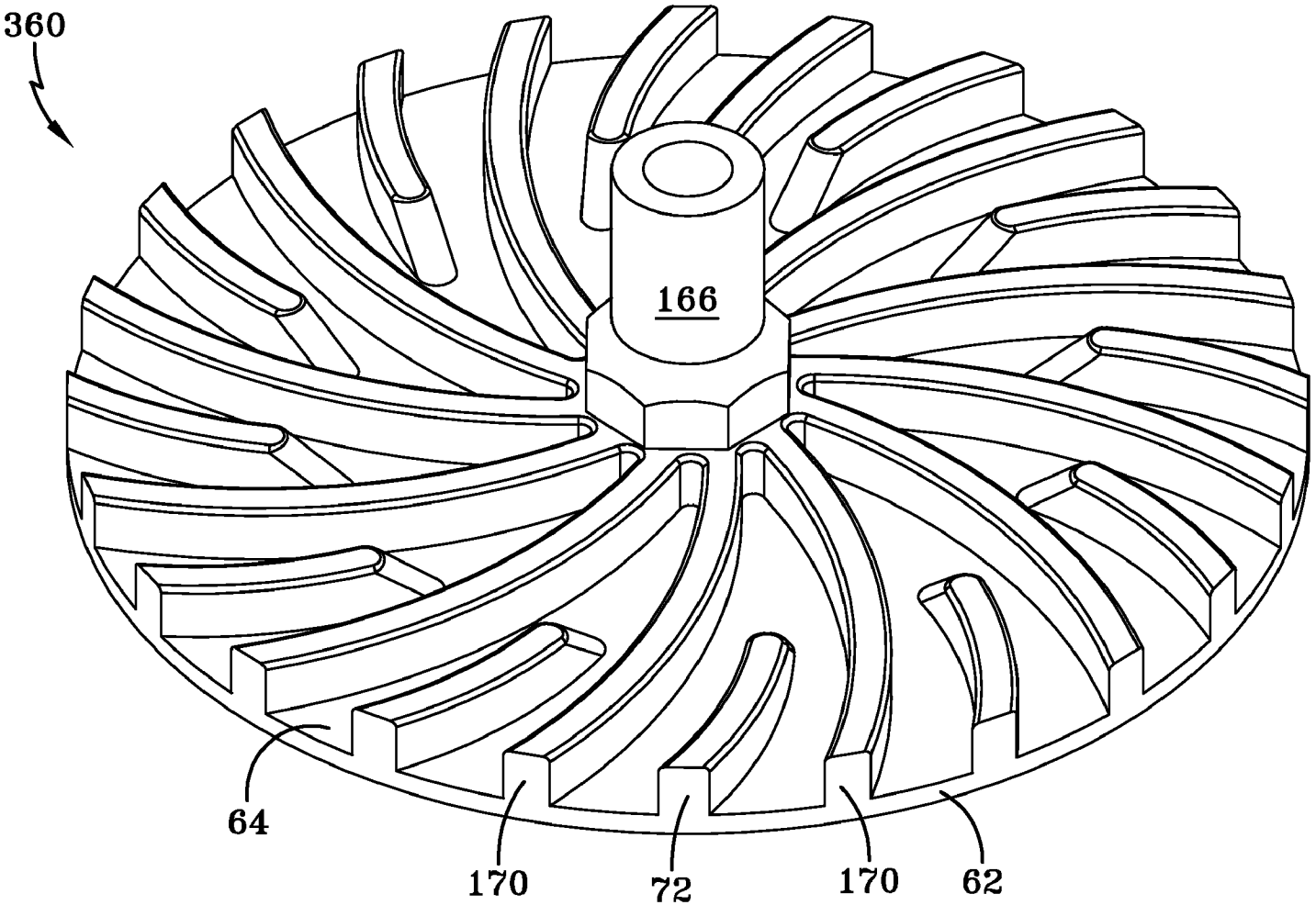
FIG. 4 is a perspective view of a third embodiment of the improved impeller.

With details of the pump in place, attention is now directed to the particular features that distinguish the embodiments of the impellers. FIGS. 2-4 show three embodiments of the impeller, which is designated as 160, 260 and 360, respectively, In FIGS. 2-4. Each of the impellers has a base 62 with a face 64 from which the blades extend. This face 64, in each instance, is the face that is directed in use towards the vortex chamber. An opposing face of the base is not shown in any of FIGS. 2-4, although, as mentioned above regarding the known impellers of the prior art, there may be reason to provide pump out vanes on the opposing face in some applications. Each impeller embodiment 160, 260, 360 is provided with a central hub region. The central hub region provides an axis of symmetry for the impeller, and a shaft may either pass through this region or the impeller may be connected to a shaft in this region.

The face 64 of each impeller embodiment 160, 260, 360 has a plurality of primary blades. These primary blades are in general characterized by symmetrical placement around the periphery of the face 64 and a continuous web of blade material that extends from the periphery to the central hub 66. In FIG. 2, impeller 160 has primary blades 70 that are radial, while FIGS. 3 and 4 show blades 170 that are curved in a backswept manner.

The central hub regions 66 of FIGS. 2 and 3 are shown as being raised above the base 62 to the same height as the respective primary blades 70, 170. The central hub region 166 shown in FIG. 4 is built up substantially higher than the height of the primary blades 170.

In each of the embodiments, the impellers 160, 260, 360 are further provided with a corresponding plurality of secondary or splitter blades. Each splitter blade has the same shape as the primary blade with which it is used, that is, a radial splitter blade 72 is used with radial primary blade 70 in FIG. 2 and a curved, backswept splitter blade 172 is used with curved primary blade 170 in FIGS. 3 and 4. One splitter blade 72, 172 is provided for each pair of adjacent primary blades 70, 170. Each splitter blade 72, 172 is configured to run in parallel relationship, equally spaced between a pair of the primary blades 70, 170.

At any given radial distance from the axis of the impeller 60, 160, 260, the distance between two adjacent blades can be defined as the length of a chord drawn between the intersections of the facing edges of the respective blades with the radius. Using that definition, the term "channel flow area" is the area defined by the product of the chordal distance between a pair of adjacent blades and the height of the blade (either the splitter blade or the primary blade). Channel flow area is a function of the radial distance from the center of the impeller. Channel flow area between a splitter blade and one of the adjacent primary blades decreases as the distance from the axis decreases (as one moves inwardly). In what is presently believed to be a preferred embodiment of the impeller blade design, each splitter blade 70, 170 should extend radially inward from the periphery of the impeller 60, 160 to a radial distance where the channel flow area has declined to about 50% of the channel flow area at the periphery. At such a radial distance, the splitter blade is discontinued, so that there is not a continuous web of splitter blade material from the periphery to the central hub 66.

Figure 5:
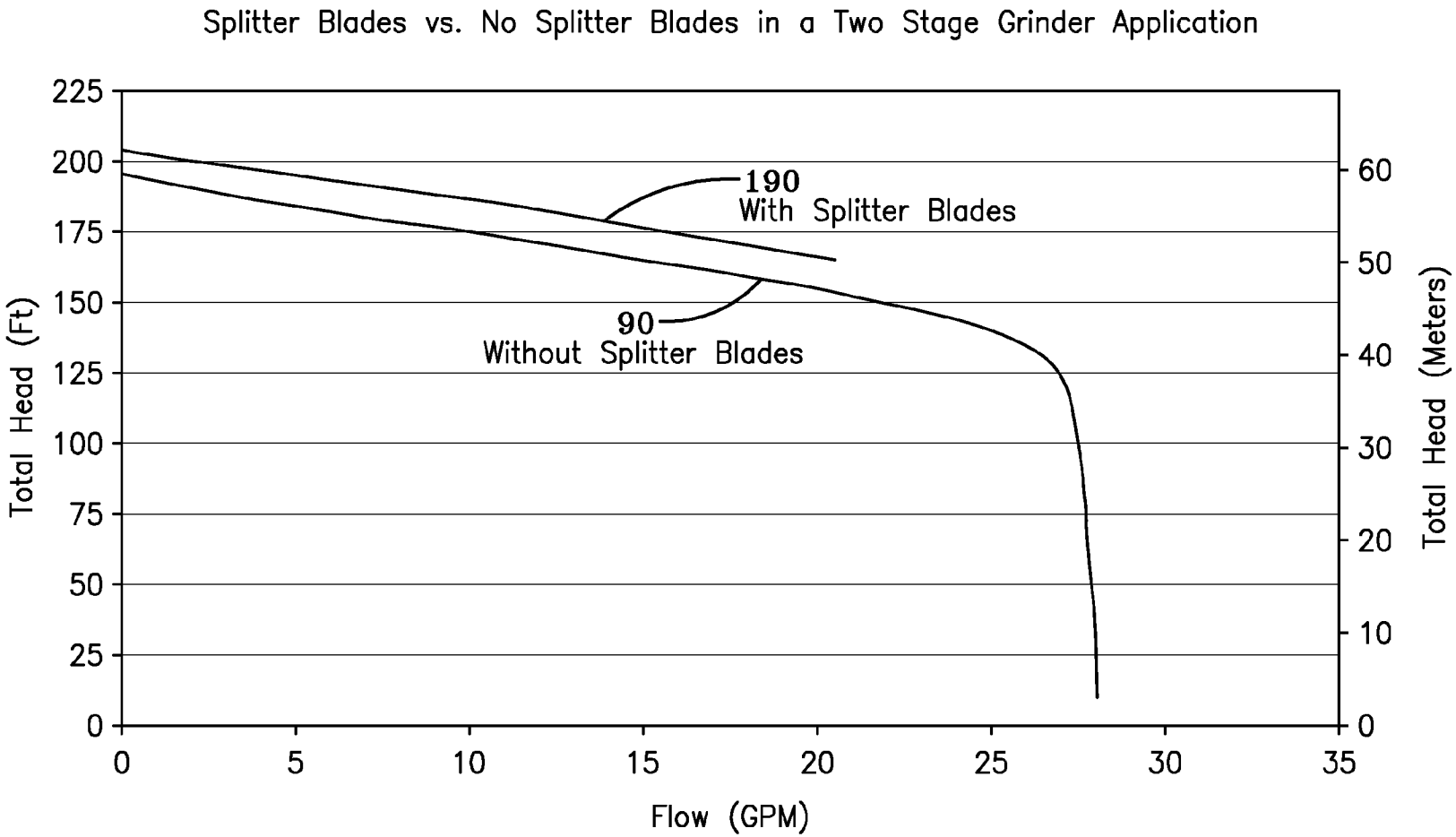
FIG. 5 is a graphical presentation of experimental data demonstrating the improvement.

Referring now to FIG. 5, the improved performance provided by an impeller of the type shown in this application is graphically presented. The plot shows the head (in ft) at the second stage discharge of a pump of the type shown in FIG. 1, plotted against the flow rate (in gallons per minute). A first line 90 in the plot shows the performance observed when an impeller having only primary blades is used in each of the two stages of the pump. A second line 190 shows the observed performance when the same impeller has a full set of splitter blades. Particularly in the range from 0 to about 20 gpm, the head provided is increased by an essentially constant amount, although total head decreases essentially linearly in that range. Beyond about 20 gpm, the head provided decreases more quickly, and the amount of improvement provided by the splitter also decreases. At about 30 gpm, the amount of improvement is largely eliminated, although it is believed that this effect may be largely caused by choking of the flow by the grinder portion.

Figure 6:
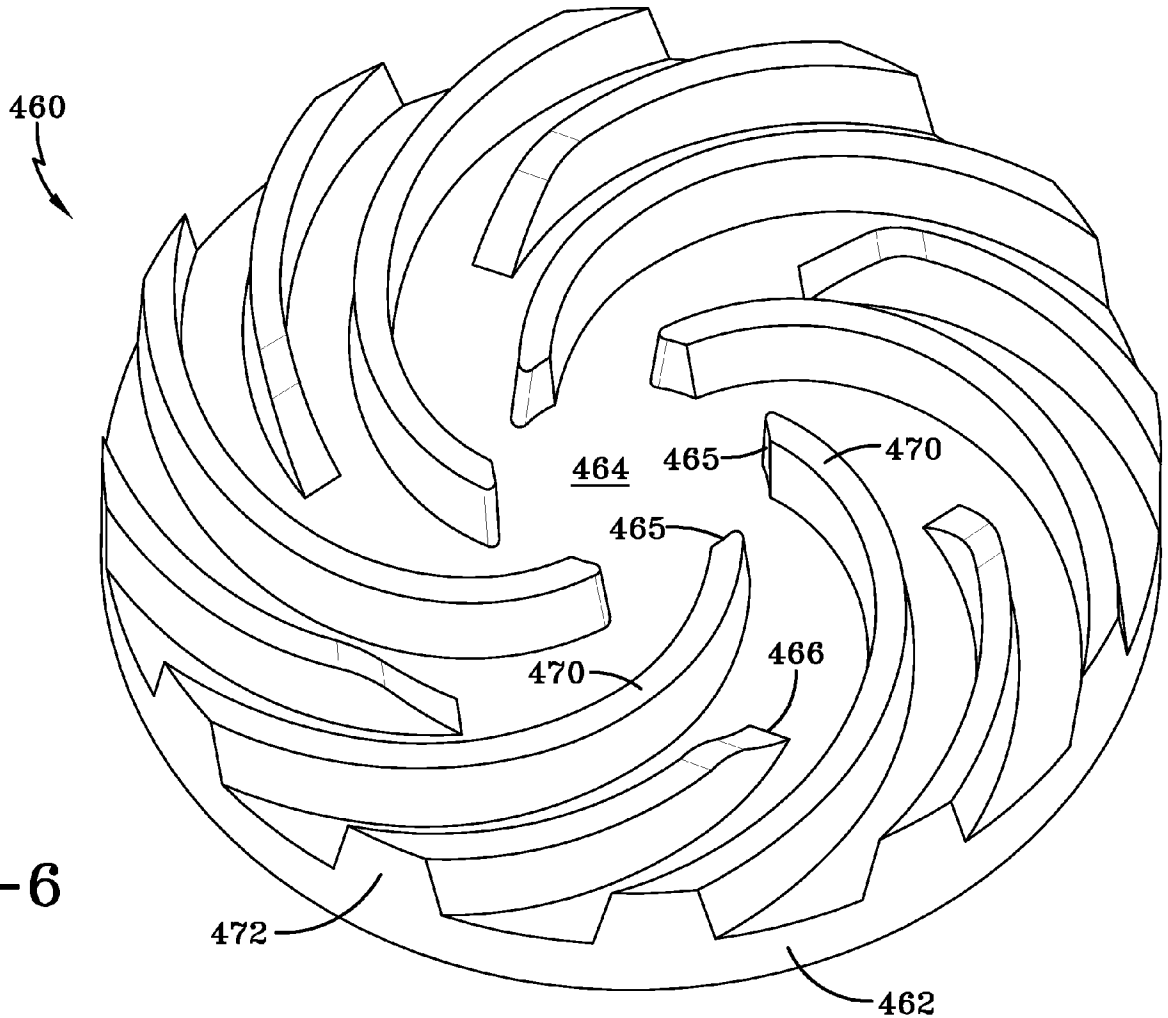
FIG. 6 is a perspective view of a fourth embodiment of the improved impeller.

FIG. 6 provides a perspective view of another embodiment 460 for an improved impeller. The embodiment 460 shown here is similar to that which was shown in FIGS. 3 and 4, with the major exception being that the embodiment shown here lacks a central hub feature. In this embodiment, a base plate 462 has a face 464 from which the blades extend. A set of symmetrically-positioned primary blades 470 extend from the plate periphery to a first point 465, which is at a first distance radially from the central axis of the base plate. The splitter blades 472 extend from the plate periphery to a second point 466, where the radial distance from the central axis to the second point is greater than the radial distance from the central axis than the first point. In this embodiment 460, as in the previous embodiments 60, 160, 360, the radial distance from the central axis to the second point 462 may be approximately 45 to 50 percent of the radial distance from the central axis to the plate periphery.

Having shown and described the preferred embodiments, those skilled in the art will realize that many variations and modifications may be made to affect the preferred embodiments and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. An impeller, for use with a vortex pump, comprising:

a circular base plate with a central axis of symmetry and a face surface defining a plate periphery;

a plurality of primary blades, each primary blade extending axially from the face surface and extending in the radial direction beginning at a first point outwardly from the central axis and ending at the plate periphery; and a plurality of secondary blades, each secondary blade extending axially from the face surface and extending in the radial direction from a second point outwardly from the central axis to the plate periphery, with one secondary blade arranged between each adjacent pair of primary blades, the second point being further in the radial direction from the central axis than the first point.

2. The impeller of claim 1, further comprising:

a central hub, co-axial with the central axis and extending axially from the face surface defining a height and extending radially from the central axis to said first point to define a hub periphery.

3. The impeller of claim 2, wherein:

each of the primary and secondary blades has a height in the axial direction substantially equal to the central hub height.

4. The impeller from claim 1, wherein:

each primary and secondary blade is aligned along a diameter of the base plate.

5. The impeller from claim 1, wherein:

each primary blade extends in a backswept curved manner from the first point to the plate periphery and each secondary blade extends in a parallel backswept manner from the second point to the plate periphery.

6. The impeller of claim 1, wherein:

the radial distance from the central axis to the second point is about 45 to 55 percent of the radial distance from the central axis to the plate periphery.

7. The impeller of claim 1, wherein:

the radial distance from the central axis to the first point is in the range of from about 10 to about 30 percent of the radial distance from the central axis to the plate periphery.

8. An impeller, for use with a vortex pump, comprising:

a circular base plate with a central axis of symmetry, with a face surface defining a plate periphery;

a plurality of flow channels formed symmetrically around the face surface, each flow channel extending from the plate periphery to a first point radially outward from the central axis, each flow channel bisected by a splitter member that extends from the plate periphery to a second point that is radially outward from the central axis, the second point being farther from the central axis than the first point.

9. The impeller of claim 8, wherein:

the radial distance from the central axis to the second point is about 45 to 55 percent of the radial distance from the central axis to the plate periphery.

10. The impeller of claim 8, wherein:

the first point is located at a distance of about 10 to about 30 percent of the radial distance from the central axis to the plate periphery.

11. A vortex pump, comprising:

a vortex chamber having an axial entrance, discharge, and an impeller recess; and an impeller according to claim 1, seated in the impeller recess, the face surface of the impeller facing the axial entrance.

12. The vortex pump of claim 11, further comprising:

a grinder assembly in fluid communication with the axial entrance.

13. The vortex pump of claim 11, wherein:

the impeller has each primary and secondary blade aligned along a diameter of the base plate.

14. The vortex pump of claim 11, wherein:

each primary blade of the impeller extends in a backswept curved manner from the first point to the plate periphery and each secondary blade of the impeller extends in a parallel backswept manner from the second point to the plate periphery.

15. A vortex pump, comprising:

a vortex chamber having an axial entrance, discharge, and an impeller recess; and an impeller according to claim 8, seated in the impeller recess, the face surface of the impeller facing the axial entrance.

* * * * *